US005422659A

United States Patent [19]

Titterington et al.

[11] Patent Number: 5,422,659

[45] Date of Patent: Jun. 6, 1995

[54] METHOD OF PRINTING ON A TRANSPARENCY SHEET

[75] Inventors: Donald R. Titterington, Tualatin; Bruce D. Radke, Beaverton; James D. Rise, Lake Oswego, all of Oreg.

[73] Assignee: Tektronix, Inc., Wilsonville, Oreg.

[21] Appl. No.: 65,519

[22] Filed: May 20, 1993

Related U.S. Application Data

[62] Division of Ser. No. 868,153, Apr. 14, 1992, abandoned.

[51] Int. Cl.[6] ..... B42J 2/01

[52] U.S. Cl. ..... 347/101

[58] Field of Search ..... 347/19, 101, 104, 105; 346/134, 138

[56] References Cited

U.S. PATENT DOCUMENTS

| | | | |
|---|---|---|---|
| 4,051,285 | 9/1977 | Kramer | 428/43 |
| 4,317,138 | 2/1982 | Bryan et al. | 346/138 X |
| 4,506,302 | 3/1985 | Kurata | 346/134 X |
| 4,788,563 | 11/1988 | Omo et al. | 347/101 X |
| 4,956,230 | 9/1990 | Edwards et al. | 428/195 |
| 5,021,272 | 6/1991 | Mohri et al. | 428/40 |
| 5,084,340 | 1/1992 | Light | 428/195 |
| 5,126,762 | 6/1992 | Takeuchi et al. | 346/135.1 |
| 5,146,087 | 9/1992 | VanDusen | 250/271 |
| 5,156,709 | 10/1992 | Mammino et al. | 428/195 |

*Primary Examiner*—Benjamin R. Fuller
*Assistant Examiner*—David Yockey
*Attorney, Agent, or Firm*—Ralph D'Alessandro

[57] ABSTRACT

A printer having a paper printing mode and a transparency printing mode detects a leading edge portion of an image-receiving sheet. Based on detection of an opaque leading edge portion of a transparent sheet, the paper printing mode is disabled and a sheet size having boundaries is selected. The printer deposits ink on the transparent sheet within the boundaries of the selected sheet size.

3 Claims, 4 Drawing Sheets

METHOD OF PRINTING ON A TRANSPARENCY SHEET

This is a division of application Ser. No. 07/868,153 filed Apr. 14, 1992, now abandoned.

BACKGROUND OF THE INVENTION

This invention relates to a transparency sheet, particularly a transparency sheet for use in an ink jet printer.

U.S. patent application Ser. No. 07/715,063 filed Jun. 12, 1991 (hereinafter referred to as "the prior application") discloses an ink jet printer for forming an image on an image-receiving sheet. The disclosure of the prior application is hereby incorporated by reference herein.

The ink jet printer described in the prior application comprises a drum for supporting the image-receiving sheet, which is typically of paper, as ink drops are deposited on the sheet to form the desired image. A stepper motor is connected drivingly to the drum for rotating the drum, and an ink jet head is mounted on a carriage that extends parallel to the axis of the drum. The carriage is movable longitudinally of the drum, and as the carriage moves, the ink jet head is energized to deposit ink drops on the sheet.

In order to load the printer with a sheet, the drum is rotated to a load position and a clamp at the periphery of the drum is opened. The sheet is fed substantially tangentially towards the clamp, and the clamp is closed and thereby grips the leading edge portion of the sheet. The drum is rotated through about 70° from the load position to a print start position, in which the clamp is close to the path of the ink jet head. During printing, the carriage is driven axially of the drum while the ink jet head scans the sheet and ejects ink drops onto the sheet, and the drum is rotated stepwise at the end of each scan of the ink jet head. At the end of printing, the drum is rotated in the same direction until the trailing edge of the sheet is at an exit position, and the drum is then rotated in the reverse direction, introducing the trailing edge of the sheet into an exit path. The clamp is opened and releases the leading edge portion of the sheet and the sheet is discharged from the printer.

In a practical implementation of the printer described in the prior application, the printer includes two reflective sensors for sensing the presence of a paper sheet on the drum. Each sensor includes a light emitter positioned to direct a light beam towards the drum and a light detector for receiving reflected light. The surface of the drum is highly reflective and reflects light in a specular fashion, whereas paper reflects light in a diffuse manner. Therefore, when paper is interposed between a sensor and the surface of the drum, the sensor provides an output signal having a lower level than when there is no paper present. It is essential to proper operation of the sensors that the surface of the drum remain highly reflective, and therefore it is important that no ink be applied to the drum. Further, if ink is applied to the drum there is an increased possibility of sheet misfeeds, since the surface of the drum then has different mechanical properties from when it is clean.

One of the sensors (the Y-axis sensor) is located stationarily between the load position and the print start position. When the drum rotates from the load position to the print start position, the output of the Y-axis sensor indicates whether the sheet has been successfully loaded. If the sheet has been successfully loaded, the output of the Y-axis sensor allows further operation to take place. If the output signal of the Y-axis sensor indicates that the sheet has not been successfully loaded, the printing operation aborts and another attempt is made to load a sheet. Further, towards the end of the printing operation the Y-axis sensor detects the trailing edge of the sheet and its output ensures that printing ceases before the trailing edge reaches the printing position.

The other sensor (the X-axis sensor) is mounted on the traversing carriage with the ink jet head. When the drum has rotated to the start print position, but before printing takes place, the carriage is driven lengthwise of the drum and the X-axis sensor scans the drum. The output signal of the X-axis sensor during this probe scan confirms that there is an image-receiving sheet at the printing position and also provides information regarding the location of the edges of the sheet along the axis of the drum. This information is used to ensure that ink is applied only between the two edges of the sheet that extend longitudinally with respect to the path of movement of the sheet. The X-axis sensor continues to sense the longitudinal edges of the sheet throughout the printing operation so that if, for example, the sheet becomes narrower from the leading edge towards the trailing edge, the image will be progressively cropped to ensure that no ink is applied to the drum.

It is frequently desirable to form an image on a transparency sheet to allow the image to be displayed using an overhead projector. Transparency sheets for overhead projectors are typically made of polyester film. A transparency sheet cannot normally be printed successfully in an ink jet printer simply by feeding the transparency sheet into the printer instead of a paper sheet. For example, if a transparency sheet were introduced into the printer described in the prior application without making changes to accommodate the difference between the optical properties of a transparency sheet and those of a paper sheet, the Y-axis sensor would not detect the presence of the sheet and accordingly the printer would not recognize that the sheet had been loaded and printing could not take place. In addition, the mechanical properties of a transparency sheet made of polyester film are quite different from those of paper of the kind normally used in an ink jet printer, particularly with respect to the coefficient of friction, and this can cause difficulties in handling a transparency sheet in an ink jet printer.

SUMMARY OF THE INVENTION

According to a first aspect of the invention there is provided a transparency sheet comprising a substrate of transparent material, said substrate having an image-receiving portion and a leading edge portion joined to the image-receiving portion, and the sheet further comprising a layer of opaque material adhering to the substrate over said leading edge portion.

According to a second aspect of the invention there is provided a transparency sheet comprising a substrate of transparent material, said substrate having an image-receiving portion and an edge portion joined to the image-receiving portion along an easily torn line, and a layer of material attached to the edge portion, said layer having frictional properties substantially similar to those of paper of the kind used in an ink jet printer.

According to a third aspect of the invention there is provided a method of operating a printer having a drum for supporting an image-receiving sheet and a print head movable axially of the drum for depositing ink on the sheet, the printer having a paper printing mode in which it deposits ink on the sheet within an area extending substantially from a detected leading edge to a detected trailing edge, but not beyond, said method comprising storing information relating to at least two sheet sizes, providing a transparency sheet comprising a transparent image-receiving portion and an opaque leading edge portion joined to the image-receiving portion, delivering the transparency sheet to the drum and clamping the leading edge portion of the sheet to the drum, optically detecting the leading edge portion of the sheet, disabling the paper printing mode of the printer, selecting one of said sheet sizes based on the optical detection of the leading edge portion, and depositing ink on the sheet within the boundaries of the selected sheet size.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
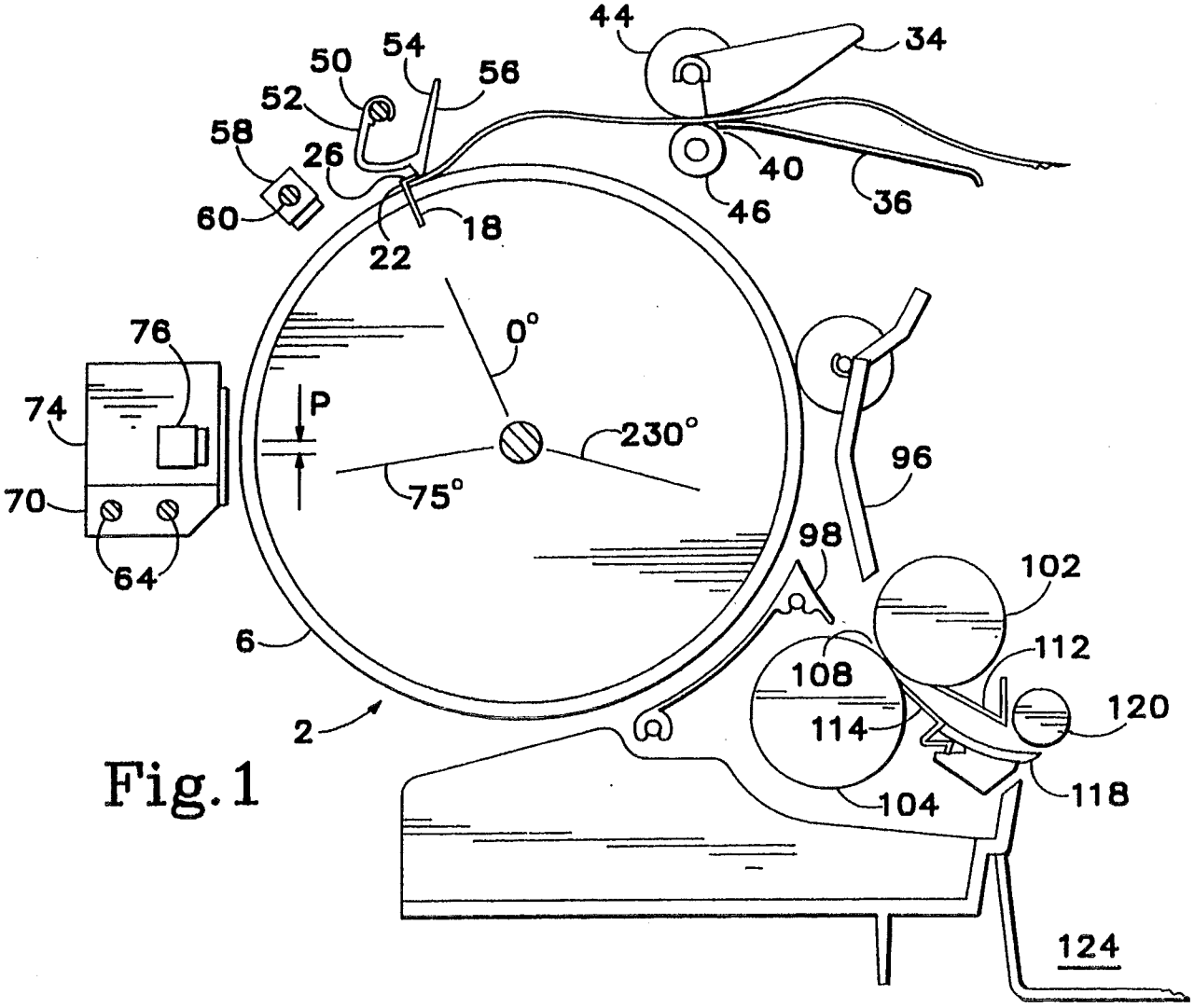
FIG. 1 is side elevation of an ink jet printer embodying the present invention.
Figure 2:
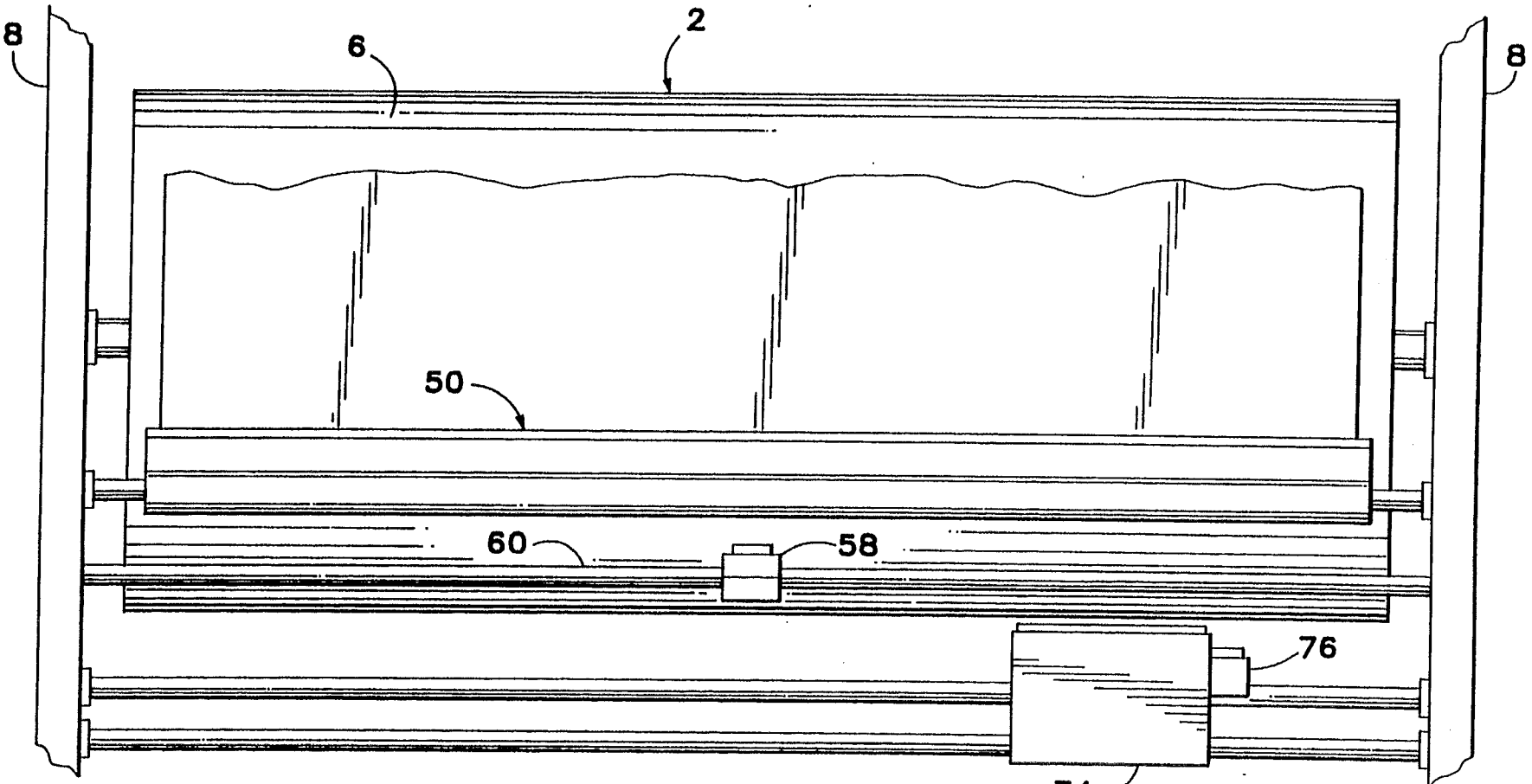
FIG. 2 is a top plan view of the printer shown in FIG. 1.
Figure 3:
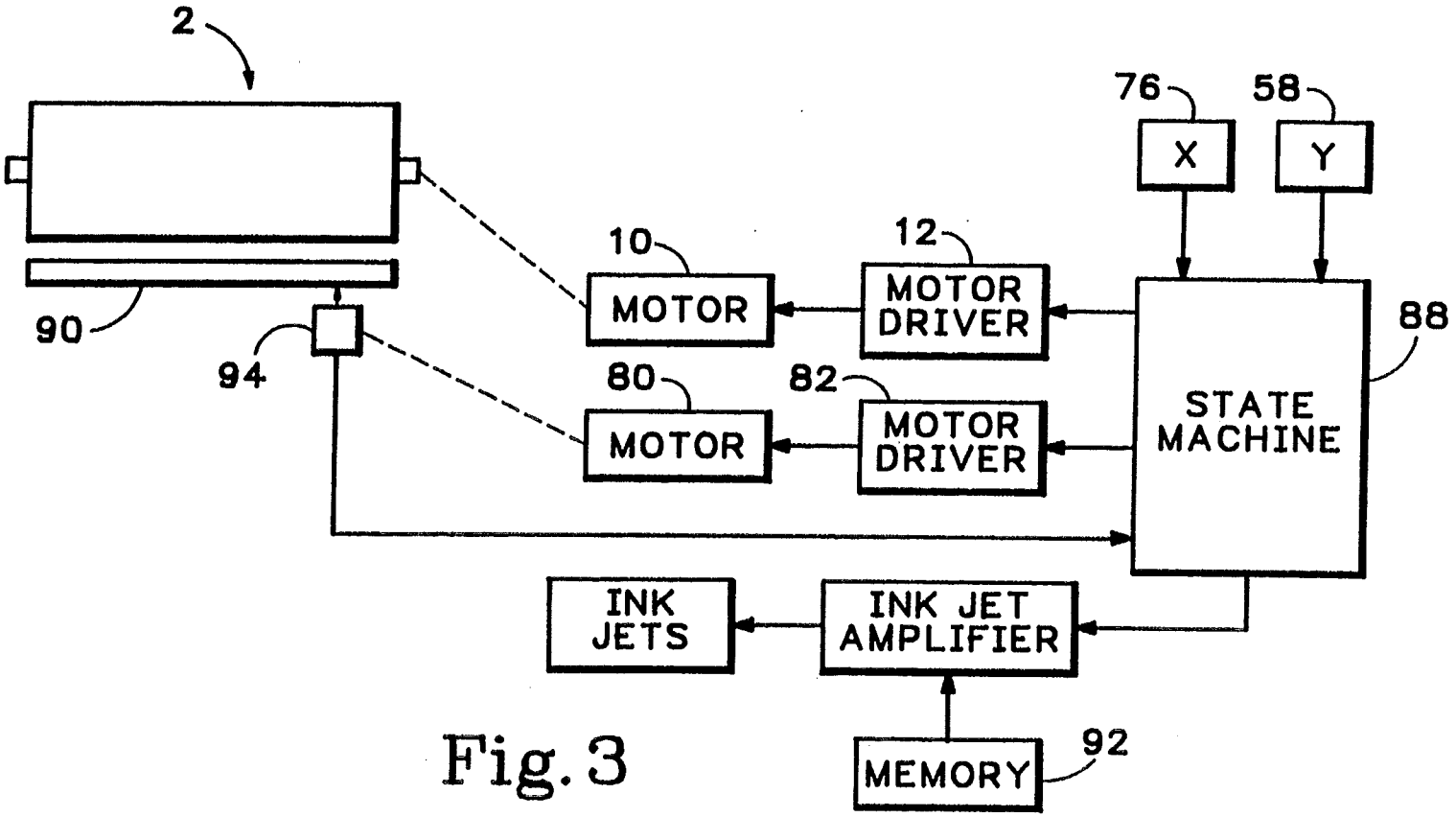
FIG. 3 is a block diagram illustrating the control circuitry of the printer.

Referring to FIGS. 1–3, the illustrated printer comprises a drum 2 having a mantle 6 with a cylindrical external surface. The drum is mounted in a frame 8 to rotate about the central axis of the external surface of the mantle and is driven to rotate by means of a stepper motor 10 (FIG. 3). The manner in which the mantle is supported and the manner by which drive is imparted to the drum 2 are described in detail in the prior application. The motor 10 operates in response to a motor driver 12 (FIG. 3), and a motor position counter (not shown) is incremented each time a pulse is applied to the stepper motor to rotate the drum 2 in the counterclockwise direction shown in FIG. 1 and is decremented each time a pulse is applied to the motor to rotate the drum 2 in the clockwise direction. Accordingly, the count accumulated in the motor position counter is representative of the instantaneous angular position of the drum 2.

As described in the prior application, the mantle of the drum 2 is formed with slots through which stem elements 18 of a clamp 22 extend. The stem elements 18 extend substantially radially relative to the peripheral surface of the mantle. The clamp 22 also includes a gripping portion 26 that is connected to the stem elements and projects substantially at right angles from the stem elements in the clockwise direction seen in FIG. 1. The clamp 22 is spring biased towards the closed position, in which the gripping portion 26 engages the peripheral surface of the mantle 6, and is displaceable to an open position by means of a clamp opening mechanism (not shown). The gripping portion 26 has a slot (not shown) that is equidistant from the two ends of the drum 2, for a purpose that will become apparent as this description proceeds. The structure of the clamp 22 and the mechanism for opening the clamp are described in greater detail in the prior application.

When a sheet 28 is to be loaded into the printer, pulses are applied to the stepper motor 10 to rotate the drum to bring the clamp 22 to the position shown in FIG. 1. This position is referred to herein as the 0° position, and other angular positions of the drum about its central axis are referred to by their angular displacement from the 0° position in the counterclockwise direction seen in FIG. 1.

The printer further comprises entry guides 34, 36 defining an entry path for loading a sheet 28 into the printer. The entry guides 34, 36 lead to a nip 40 defined between an idler roller 44 and a driven roller 46. When a sheet 28 is to be loaded into the printer, its leading edge is introduced between the entry guides 34, 36, either manually or through use of an automatic picker, and the rollers 44, 46 advance the sheet to bring its leading edge towards the clamp 22. The minimum length of sheet 28 that can be loaded into the printer is at least as great as the distance between the nip 40 and the 0° position, since the rollers 44, 46 must have control of the sheet 28 in order to deliver its leading edge portion to the clamp.

At about the 0° position is a clamp guide 50, which is generally U-shaped and is pivotally mounted to the printer frame 8 at the free end of one limb 52, while its other limb 54 presents a planar guide surface 56 towards the leading edge of a sheet 28 leaving the nip 40. When the clamp 22 is in the 0° position and is open, the gripping edge 26 of the clamp 22 engages a notch between the base of the clamp guide 50 and the lower end of the limb 54, so that the clamp 22 guide pivots away from the peripheral surface of the mantle and the surface 56 of the limb 54 directs a sheet 28 received from the rollers 44 and 46 to the clamp 22. When the clamp 22 is closed and the drum 2 rotates in the counterclockwise direction, the clamp guide 50 pivots in the clockwise direction and the lower end of the limb 54 serves to retain the sheet 28 in contact with the mantle.

At about the 20° position a Y-axis sensor 58 is supported by a rail 60 for emitting light toward the exterior surface of the mantle 6 or a sheet 28 thereon and collecting reflected light. The sensor 58 provides an output signal representative of the power at which it collects light. The Y-axis sensor 58 is equidistant from the two ends of the drum 2, so that when the drum 2 rotates the clamp 22 passes the 20° position, the slot in the gripping portion 26 passes under the Y-axis sensor 58. Therefore, the gripping portion 26 does not obscure the mantle or a sheet 28 thereon from the Y-axis sensor 58.

At about the 75° position is a pair of guide rails 64. These guide rails 64 are supported by the frame 8 and serve to support and guide movement of a carriage 70 that carries both an ink jet head assembly 74 and an X-axis sensor 76. The carriage 70 is coupled drivingly to a servomotor 80 (FIG. 3), which drives the carriage 70 reciprocatingly along the guide rails 64 in response to a command provided to a motor driver 82. A clock strip 90 extends parallel to the drum 2 adjacent the path of the carriage 70, and an encoder 94 carried by the carriage 70 interacts with the clock strip 90 and generates pulses as the carriage 70 moves along the guide rails 64. A carriage position counter (not shown) is incremented each time a pulse is provided by the encoder when the carriage 70 is moving in one direction and is decremented each time a pulse is provided by the encoder when the carriage 70 is moving in the opposite direction. The count accumulated in the carriage position counter is therefore representative of the instantaneous position of the carriage 70 along the axis of the drum.

The ink jet head assembly includes an array 84 of ink jet heads and associated ink reservoirs and is connected by means not shown to an ink jet drive amplifier 86. When the ink jet drive amplifier 86 is in operation, the ink jet heads eject drops of ink toward a printing zone P at the periphery of the drum.

The ink jet drive amplifier 86 and the motor drivers 12, 82 operate under control of a state machine 88 (FIG. 3). The state machine 88 has a paper printing mode and a transparency printing mode, both of which will be described in further detail below.

In operation, the printer receives information defining an image and stores this information in a memory 92. When the sheet 28 that is loaded into the printer is a sheet of paper, the Y-axis sensor 58 detects the leading edge of the sheet 28 when the drum 2 is rotated to advance the clamp 22 counterclockwise from the 0° position and confirms that the sheet has been loaded. In response to the output of the Y-axis sensor, the state machine enters the paper printing mode.

The drum rotates to bring the clamp 22 to the 70° position and comes to a halt. The carriage 70 traverses the drum 2 once in each direction and during this probe scan the X-axis sensor 76 detects the position of each longitudinal edge of the sheet 28 along the axis of the drum 2. The state machine 88 then enters a printing mode, in which the drum 2 is rotated stepwise and between steps the print head scans the drum 2 and the ink jet heads 84 deposit ink on the paper. The 70° position is such that the ink jet heads 84 are able to deposit ink up to about 0.5 cm from the leading edge of the sheet 28, and the X-axis sensor 76 controls energization of the ink jet heads 84 so that they can print up to about 0.5 cm from each longitudinal edge of the sheet 28. The Y-axis sensor 88 continues to detect the sheet 28 until the trailing edge of the sheet 28 passes under the Y-axis sensor 88. The state machine 88 stops the printing operation when the drum 2 has rotated through a predetermined angle after the Y-axis sensor 58 detects the trailing edge of the sheet 28 such that the ink jet head is able to deposit ink up to about 0.5 cm from the trailing edge of the sheet 28.

When printing is complete, the drum 2 rotates through a further angle of about 165°, and thereby positions the trailing edge of the sheet 28 above an exit path defined between exit guides 96, 98. The drum then rotates in the clockwise direction and introduces the trailing edge of the sheet into the exit path.

The exit guides 96, 98 of FIG. 1 feed the trailing edge towards a pair of press rolls 102, 104 defining a nip 108. At least one of the press rolls 102, 104 is driven, and as they feed the sheet 28 through the nip 108, drops of thermal wax ink deposited on the sheet 28 are compressed. The rolls 102, 104 feed the sheet 28 between stripper guides 112, 114, which direct the sheet 28 to a narrow gap defined between an output guide 118 and a selectively driven exit roller 120. Operation of the exit roller 120 deposits the sheet 28 in a collection tray 124.

Figure 4:
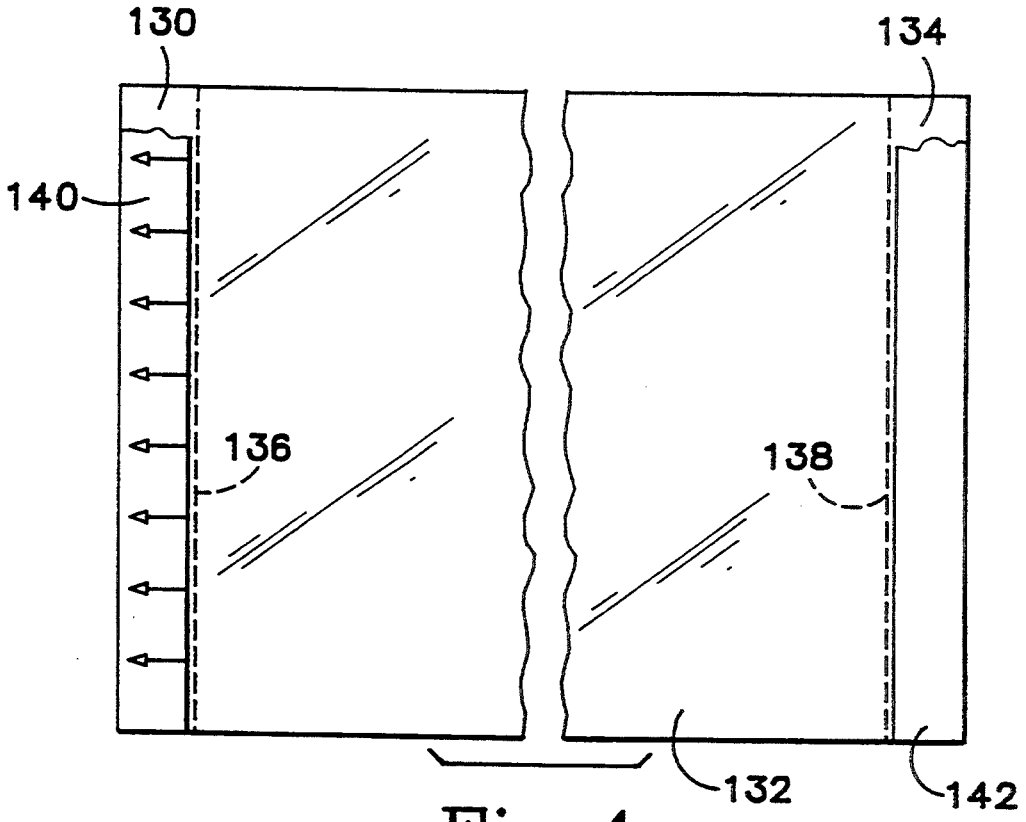
FIG. 4 is plan view of a transparency sheet designed for use in the printer shown in FIGS. 1–3, with a portioned removed
Figure 5:
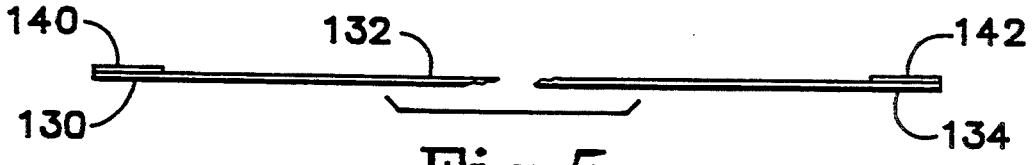
FIG. 5 is a side view of the transparency sheet of FIG. 4.

FIGS. 4 and 5 illustrate a transparency sheet 128 that comprises a substrate of polyester material having a leading edge strip 130 that is about 1.2 cm long and a trailing edge strip 134 that is also about 1.2 cm long. The two strips 130, 134 extend along the two longer edges of the main body 132 of the sheet 128 and are detachable from the main body of the sheet along lines of perforation 136, 138 leaving a secondary sheet of a standard size, for example so-called letter size or international A4 size. The leading edge strip has a coating 140 of white ink on one side and has contrasting arrows imprinted on the coating 140 to indicate the direction of feed into the printer. Paper tape 142 is bonded to the trailing edge strip on the same side as the ink coating 140. The sheet is preferably provided with a coating 140 of finely divided silica on its printed side.

When the transparency sheet 128 is loaded into the printer, the leading edge strip is received in the clamp 22, and when the drum 2 rotates the clamp past the Y-axis sensor, the Y-axis sensor detects that a sheet has been successfully loaded. However, the leading edge strip obscures the reflective surface of the drum 2 over a rotational interval that is very much smaller than the interval corresponding to the minimum length of sheet that can be loaded, and the state machine 88 interprets this as indicating that the sheet 128 that has been loaded is a transparency sheet. The state machine therefore enters the transparency printing mode.

When the clamp 22 reaches the 70° position and the carriage 70 first traverses the drum 2, the X-axis sensor's 76 probe scan allows information regarding the X-axis dimension of the leading edge strip to be obtained from the carriage position counter. The state machine 88 includes a table containing data defining several standard sizes of sheet 128. For example, the stored data might contain information defining boundaries for standard letter size (8.5 inches by 11 inches, or 21.6 cm by 27.9 cm) and international A4 size (21.0 cm by 29.7 cm). In these two cases, the leading edge strips are, respectively, 27.9 cm long and 29.7 cm long. The main body of the transparency sheet is either 21.6 cm by 27.9 cm or 21.0 cm by 29.7 cm. Thus, the overall dimension of the sheet 128 perpendicular to the leading edge strip is 24.0 cm for letter size and 23.4 cm for international A4 size. In the transparency printing mode, the output signal provided by the X-axis sensor 76 during the probe scan allows the X-dimension of the leading edge strip to be determined, and the state machine 88 uses this information to determine whether the length of the leading edge strip corresponds to letter size or international A4 size. Further, the information provided by the X-axis sensor 76 allows the location of the transparency sheet 128 along the X-axis to be determined.

As mentioned previously, the printer prints to within about 0.5 cm of the leading edge of the sheet 128 in the paper printing mode. Since the clamping portion 26 of the clamp 22 has a dimension of about 0.3 cm about the periphery of the drum, this implies that printing takes place to within about 0.2 cm of the clamping portion 26. In the transparency printing mode, if printing took place within 0.2 cm of the clamping portion 26, ink would be deposited on the leading edge strip.

When the probe scan has been completed, the drum 2 is further rotated in the counterclockwise direction to bring the main body of the transparency sheet 128 into the printing zone, and printing is carried out in the usual way by scanning the ink jet head over the sheet 128 and selectively energizing the ink jet head. The coating of silica on the transparency sheet 128 improves the ink-receiving qualities of the sheet 128 as compared with uncoated polyester film.

During printing in the transparency priority mode, the X-axis sensor 78 is not able to detect the edges of the sheet 128 and therefore the ends of the printing scan are not controlled dynamically by the output of the X-axis sensor 76, but rather by the output provided during the probe scan. Printing continues until just before the trailing edge strip enters the printing zone, this being determined on the basis of the size of the main body of the transparency sheet as stored in the memory. When printing is complete, the drum 2 is further rotated in the counterclockwise direction until it reaches the angular position at which the trailing edge strip is just above the exit path. The drum 2 then rotates in the clockwise direction, feeding the trailing edge strip into the exit guide towards the nip 108. The coefficient of friction between the trailing edge strip and the upper pressure roll is considerably higher than that between polyester film and the pressure roll, and this results in improved feeding of the sheet 128 into the nip and subsequent ejection of the sheet 128 into the collection tray. Further, the coating of silica provides roughness or tooth for improved feeding of the sheet 128.

It will be appreciated that the invention is not restricted to the particular embodiment that has been described and that variations may be made therein without departing from the scope of the invention as defined in the appended claims and equivalents thereof.

We claim:

1. A method of operating a printer having a drum for supporting an image-receiving sheet having a leading edge and a trailing edge and a print head movable axially of the drum for depositing ink on the sheet, the printer having a paper printing mode in which the printhead deposits ink on the sheet within an area extending substantially from the leading edge to the trailing edge, but not beyond, said method comprising the steps of:

storing information relating to at least two sheet sizes having boundaries, providing a transparency sheet as the image-receiving sheet comprising a transparent image-receiving portion and an opaque leading edge portion joined to the image-receiving portion, delivering the transparency sheet to the drum and clamping the leading edge portion of the sheet to the drum, optically detecting the leading edge portion of the sheet, disabling the paper printing mode of the printer, selecting one of said sheet sizes based on the optical detection of the leading edge portion, and depositing ink on the sheet within the boundaries of the selected one of said sheet sizes.

2. A method according to claim 1 further comprising the steps of rotating the drum to bring the leading edge portion of the sheet from the position at which the sheet is clamped to the drum to a printing position, and wherein the step of optically detecting the leading edge portion of the sheet comprises optically detecting an extent of the leading edge portion of the sheet in a peripheral direction of the drum, and disabling the paper printing mode of the printer in response to detection of the extent of the leading edge portion.

3. A method according to claim 1, wherein the step of optically detecting the leading edge portion of the sheet comprises the step of detecting an extent of the leading edge portion of the sheet in an axial direction of the drum and selecting one of said sheet sizes based on the extent of the leading edge portion.

* * * * *